US008164529B2

(12) United States Patent
Parsche et al.

(10) Patent No.: US 8,164,529 B2
(45) Date of Patent: Apr. 24, 2012

(54) LOOP ANTENNA INCLUDING IMPEDANCE TUNING GAP AND ASSOCIATED METHODS

(75) Inventors: Francis Eugene Parsche, Palm Bay, FL (US); Dennis Lee Tebbe, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 313 days.

(21) Appl. No.: 12/254,341

(22) Filed: Oct. 20, 2008

(65) Prior Publication Data

US 2010/0097275 A1 Apr. 22, 2010

(51) Int. Cl.
*H01Q 11/12* (2006.01)
*H01Q 7/00* (2006.01)

(52) U.S. Cl. ..... 343/741; 343/742; 343/743; 343/744; 343/748

(58) Field of Classification Search ..... 343/741, 343/742, 743, 744, 748
See application file for complete search history.

(56) References Cited

U.S. PATENT DOCUMENTS

| | | | | |
|---|---|---|---|---|
| 3,078,462 | A * | 2/1963 | Herman | 343/744 |
| 4,185,289 | A | 1/1980 | DeSantis et al. | 343/770 |
| 5,426,439 | A * | 6/1995 | Grossman | 343/727 |
| 5,859,615 | A * | 1/1999 | Toland et al. | 343/753 |
| 6,201,514 | B1 * | 3/2001 | Iwasawa et al. | 343/895 |
| 6,252,561 | B1 | 6/2001 | Wu et al. | 343/866 |
| 6,590,541 | B1 | 7/2003 | Schultze | 343/741 |
| 7,298,343 | B2 | 11/2007 | Forster et al. | 343/767 |
| 2001/0028247 | A1 * | 10/2001 | King et al. | 324/312 |
| 2004/0135726 | A1 | 7/2004 | Shamir et al. | 343/700 |
| 2008/0136720 | A1 | 6/2008 | Parsche et al. | 343/741 |

FOREIGN PATENT DOCUMENTS

| | | |
|---|---|---|
| JP | 2005244283 | 9/2005 |
| JP | 2008160821 | 7/2008 |

OTHER PUBLICATIONS

"Capacitors and Capacitance," John D. Kraus, Electromagnetics, Second Edition,McGraw Hill, 1973.*

Glinski, G., "Note on Circular Loop Antennas With Non-Uniform Current Distribution", Journal of Applied Physics, American Institute of Physics. New York, US, vol. 18, Jul. 1, 1947, pp. 638-644.

(Continued)

*Primary Examiner* — Jacob Y Choi
*Assistant Examiner* — Graham Smith
(74) *Attorney, Agent, or Firm* — Allen, Dyer, Doppelt, Milbrath & Gilchrist, P.A.

(57) ABSTRACT

A loop antenna may include first and second electrical conductors arranged to define a circular shape with first and second spaced apart gaps therein. Opposing portions of the first and second electrical conductors at the first gap may define a signal feedpoint, and opposing portions of the first and second electrical conductors at the second gap may define an impedance tuning feature. The second gap may be circumferentially spaced from the first gap less than ninety degrees, and the second gap may be greater than the first gap to provide a predetermined impedance. A coaxial transmission line may form a feed inset into the loop conductor. The loop antenna may be planar and have a reduced size for ease of manufacture and use, and it may provide an isotropic radiating pattern at a predetermined operating frequency, which may avoid the need for antenna aiming.

21 Claims, 10 Drawing Sheets

OTHER PUBLICATIONS

Scott et al., "Electronic Beam Tilting 2,8 Using A Single Reactively Loaded Circular Wire Loop Antenna", IEE Proceedings: Microwaves, Antennas and Propagation, IEE, Stevenage, Herts, GB, vol. 149, No. 56, Sep. 1, 2002, pp. 271-274.

Li et al., "Determination of Reactance Loading for Circularly Polarized Circular Loop Antennas With a Uniform Traveling-Wave Current Distribution", IEEE Transactions on Antennas and Propagation, vol. 53, No. 12, Dec. 12, 2005, pp. 3920-3928.

Physical Limitations of Omni-Directional Antennas, L.J. Chu, Journal of Applied Physics, vol. 19, pp. 1163-1175 Dec. 1948.

"Electric Waves", Heinrich Hertz, Macmillan 1893.

* cited by examiner

LOOP ANTENNA INCLUDING IMPEDANCE TUNING GAP AND ASSOCIATED METHODS

FIELD OF THE INVENTION

The present invention relates to the field of communications, and, more particularly, to antennas and related methods.

BACKGROUND OF THE INVENTION

Antennas may be used for a variety of purposes, such as communications or navigation, and portable radio devices may include broadcast receivers, pagers, or radio location devices ("ID tags"). The cellular telephone is an example of a portable communications device, which is nearly ubiquitous. Antennas for portable radios or wireless devices should be small, efficient, and have a broad radiation pattern.

Orientation of a portable device may be a concern. It may be impractical to orient a radio location tag, or point a cell phone, and satellites may tumble unintentionally. When antennas having radiation pattern nulls become misoriented, unacceptable fading is a common problem. Communications need to be reliable, and increased transmitter power may be required. Thus, a nondirectional antenna having a full-coverage radiation pattern may be desirable to avoid fading.

An example of a nondirectional antenna, which does not have radiation pattern nulls, is the isotropic antenna, which has a spherical radiation pattern for equal radiation in all directions. Isotropic antennas may provide a constant signal level for all antenna orientations, for operation without fading when the antenna cannot be aimed or pointed. The directivity of an isotropic antenna is 0.0 dB and if 100 percent efficient, the isotropic antenna gain is 0 dBi. Omnidirectional antennas may have circular antenna patterns in a single plane, such as for the horizon, and an isotropic antenna may provide omnidirectional patterns in all planes.

Antennas are transducers between electric currents and radio waves, and they may have a variety of shapes. Euclidian geometric shapes, such as those known through the ages, can be favorable for antennas. They can provide the greatest area for the perimeter (circles) or the shortest length between points (lines), etc. Thus, the two canonical antenna shapes may be the line and circle, corresponding to the dipole and loop type respectively.

The thin-wire half wave dipole is an example of a line shaped antenna. It may have a $\cos^2 \theta$ radiation pattern (two petal rose in plane) with two pattern nulls, a gain of 2.1 dBi, and a 3 dB gain bandwidth of 13%. Dipole antennas may be very common in the art, yet circle shaped antennas may have advantages for gain, polarization, and otherwise.

The full wave loop antenna is an example of a circle shaped antenna. It may have a circumference of 1 wavelength, a two petal rose radiation pattern (lobes broadside to the loop plane), and a gain of 3.6 dBi. U.S. Patent Application Publication No. 2008/0136720 to Parsche et al., assigned to the present assignee, and entitled "Multiple Polarization Loop Antenna and Associated Methods" discloses a full wave loop antenna with multiple feedpoints. Multiple polarizations may be provided from the single loop, including linear, circular, and dual polarizations.

A rectangular loop antenna was described by Heinrich Hertz in 1886. In his classic work, sparks were produced by radio, and the antenna was a 0.8×1.2 meter wire rectangle ("Electric Waves", Heinrich Hertz, Macmillan 1893). Sparks were rendered at a gap in the antenna conductor, so the gap provided a detector and receiver. As the frequency neared 40 MHz, the loop was a half wavelength in perimeter, resonant (or "antiresonant"), and with a high impedance at the gap. While the high impedance was beneficial for high voltage sparks, high impedances may not be preferential for modern electronics since solid state devices operate at low voltages. For modern needs, a half wave circular loop antenna of a low driving impedance, for example, 50-Ohms may be desirable.

Newer designs and manufacturing techniques have driven electronic components to small dimensions and miniaturized many communication devices and systems. Unfortunately, antennas have not been reduced in size at a comparative level and often are one of the larger components used in a smaller communications device. Antennas become increasingly larger as the frequency decreases. At high frequencies (HF), 3 to 30 MHz for example, used for long-range communications, efficient antennas become too large to be portable, and wire antennas may be required at fixed stations. It becomes increasingly important in these communication applications to reduce not only the antenna size, but also to design and manufacture a reduced size antenna having the greatest gain for the smallest area.

U.S. Pat. No. 6,252,561 to Wu, et al. is directed to a wireless LAN antenna with a dielectric substrate having a first surface and a second surface. The first surface of the dielectric substrate has a rectangular loop. A rectangular grounding copper foil is adhered within the rectangular loop. A signal feeding copper foil is further included. One end of the signal feeding copper foil is connected to the rectangular loop and the grounding copper foil, while another end of the signal feeding copper foil runs across another end of the rectangular loop. Moreover, a layer of copper foil is plated to the back side of the printed circuit board. This back surface copper foil covers one half of the loop on the front surface. Adjustment of the transversal dimensions of the grounding copper foil will impedance-match the antenna to the feeding structure of the antenna.

Also, U.S. Pat. No. 6,590,541 to Schultze is directed to a half-loop antenna having an antenna half-loop positioned on top of a ground plane, the antenna half-loop forming an area whose outer edge forms a convex closed curve. The conductor half-loop has the form of an ellipse tapering to a point at its ends, and at the feed-in point of the conductor half-loop an inductance can be inserted, formed as a spring.

U.S. Pat. No. 4,185,289 to DeSantis et al. discloses a spherical body dipole including an annular slot feed. Complimentary radiation patterns provide near isotropic coverage. Yet, a smaller, planar radiating structure may be needed for portable personal communications, and a wire structure may be required for HF applications.

Prior approaches to forming isotropic antennas include optical approaches and or waveguides. U.S. Pat. No. 5,859,615 to Toland et al. is directed to an omnidirectional isotropic antenna using a tubular waveguide and an ellipsoid lens. U.S. Pat. No. 7,298,343 to Forster et al. is directed to an RFID tag that includes an antenna structure that is a hybrid loop-slot antenna.

However, none of these approaches are focused on providing an isotropic (radiates substantially equally in all directions) planar loop antenna component, e.g. for circuit boards, while being small in size, having desired gain for area, and with an adjustable feed impedance. Thus, there is a need for an easily manufactured, reduced size and cost, planar, isotropic loop antenna.

SUMMARY OF THE INVENTION

In view of the foregoing background, it is therefore an object of the present invention to provide an easily manufactured, reduced size and cost, loop antenna.

This and other objects, features, and advantages in accordance with the present invention are provided by a loop antenna that may include first and second electrical conductors arranged to define a circular shape with first and second spaced apart gaps therein. The loop antenna may further include opposing portions of the first and second electrical conductors at the first gap defining a signal feedpoint, for example. Opposing portions of the first and second electrical conductors at the second gap may also advantageously define an impedance tuning feature. The second gap may be circumferentially spaced from the first gap less than ninety degrees, for example. The second gap may be greater than the first gap to provide a predetermined impedance and an isotropic radiation pattern at a predetermined operating frequency for the loop antenna. Accordingly, the loop antenna provides an easily manufactured, reduced size, and reduced cost isotropic loop antenna.

Additionally, the second gap may be circumferentially spaced from the first gap by an angle in a range of 40 to 70 degrees. The second gap may also have an angular width in a range of 5 to 15 degrees, for example. Still further, the first gap may have an angular width in a range of 0.001 to 10 degrees.

The loop antenna may further include a dielectric substrate mounting the first and second electrical conductors thereon, for example.

The circular shape may have a circumference in a range of 0.3 to 0.6 times a wavelength of the predetermined operating frequency of the loop antenna. Additionally, the signal feedpoint may define a 50-Ohm signal feedpoint, for example.

In some embodiments, a portion of the first electrical conductor may include an outer conductor of a coaxial transmission line. The second electrical conductor may include an inner conductor of the coaxial transmission line extending outwardly beyond an end of the outer conductor. At least one dielectric body may be positioned at the second gap to define a frequency tuning feature.

Another aspect is directed to a method of making the loop antenna. The method may include arranging first and second electrical conductors to define a circular shape with first and second spaced-apart gaps therein so that opposing portions of the first and second electrical conductors at the first gap define a signal feedpoint. The method may also include arranging first and second electrical conductors so that opposing portions of the first and second electrical conductors at the second gap define an impedance tuning feature. The second gap may be circumferentially spaced from the first gap less than ninety degrees and located to provide a predetermined impedance and an isotropic radiation pattern at a predetermined operating frequency for the loop antenna.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in an alternative embodiment.

Figure 1:
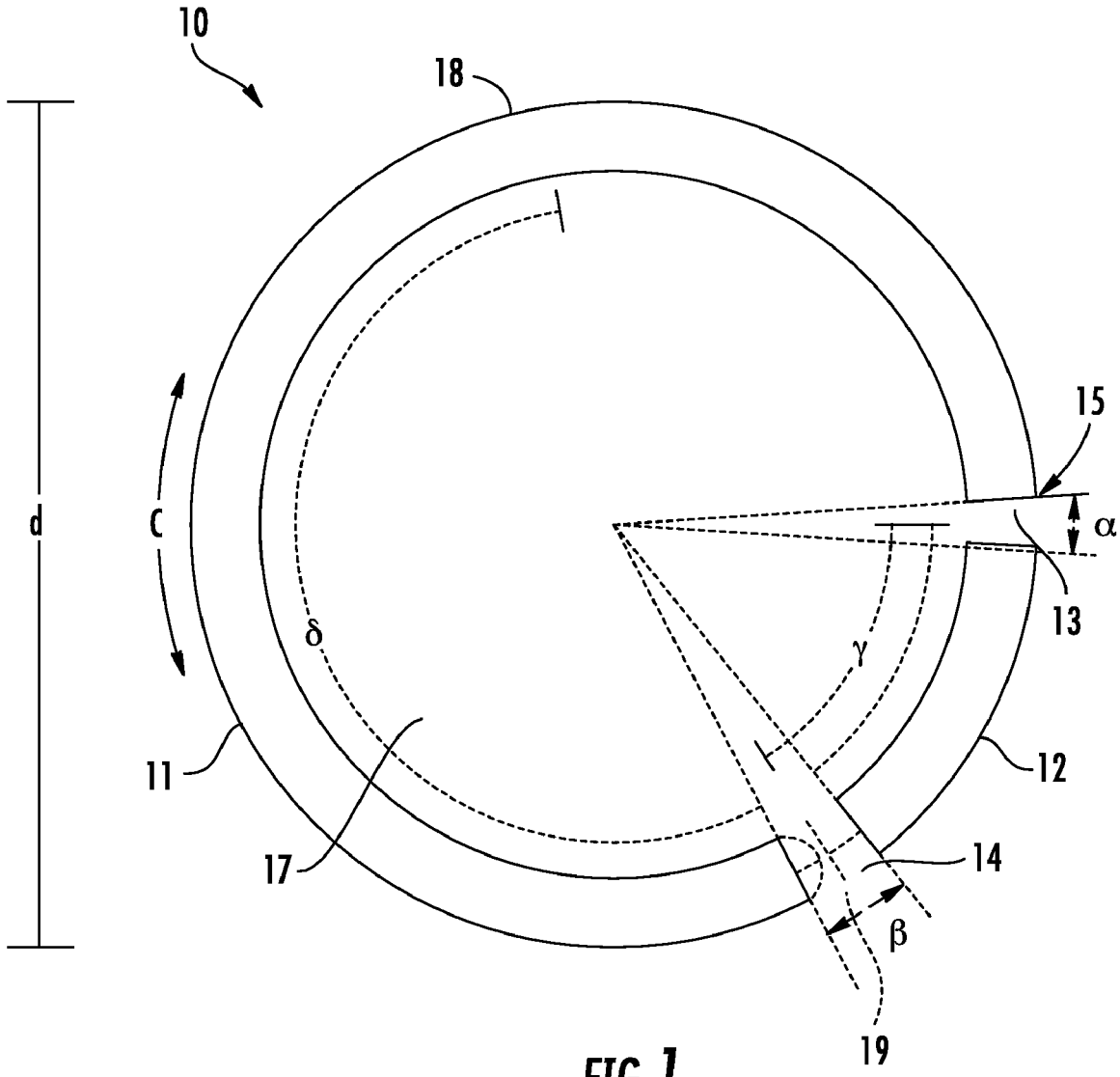
FIG. 1 is a top plan view of a loop antenna in accordance with the present invention.
Figure 2A:
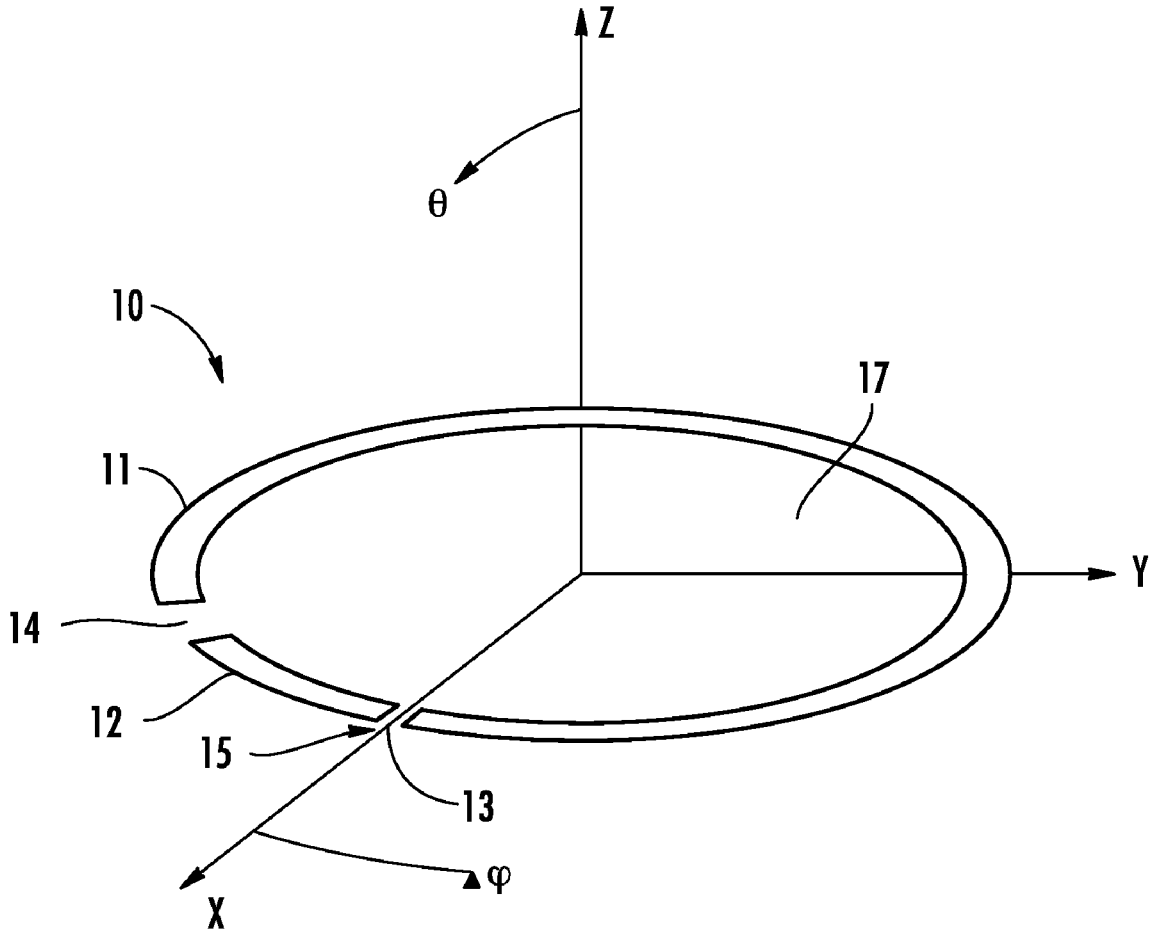
FIG. 2A is a perspective view of the loop antenna of FIG. 1 in a radiation pattern coordinate system.
Figure 2B:
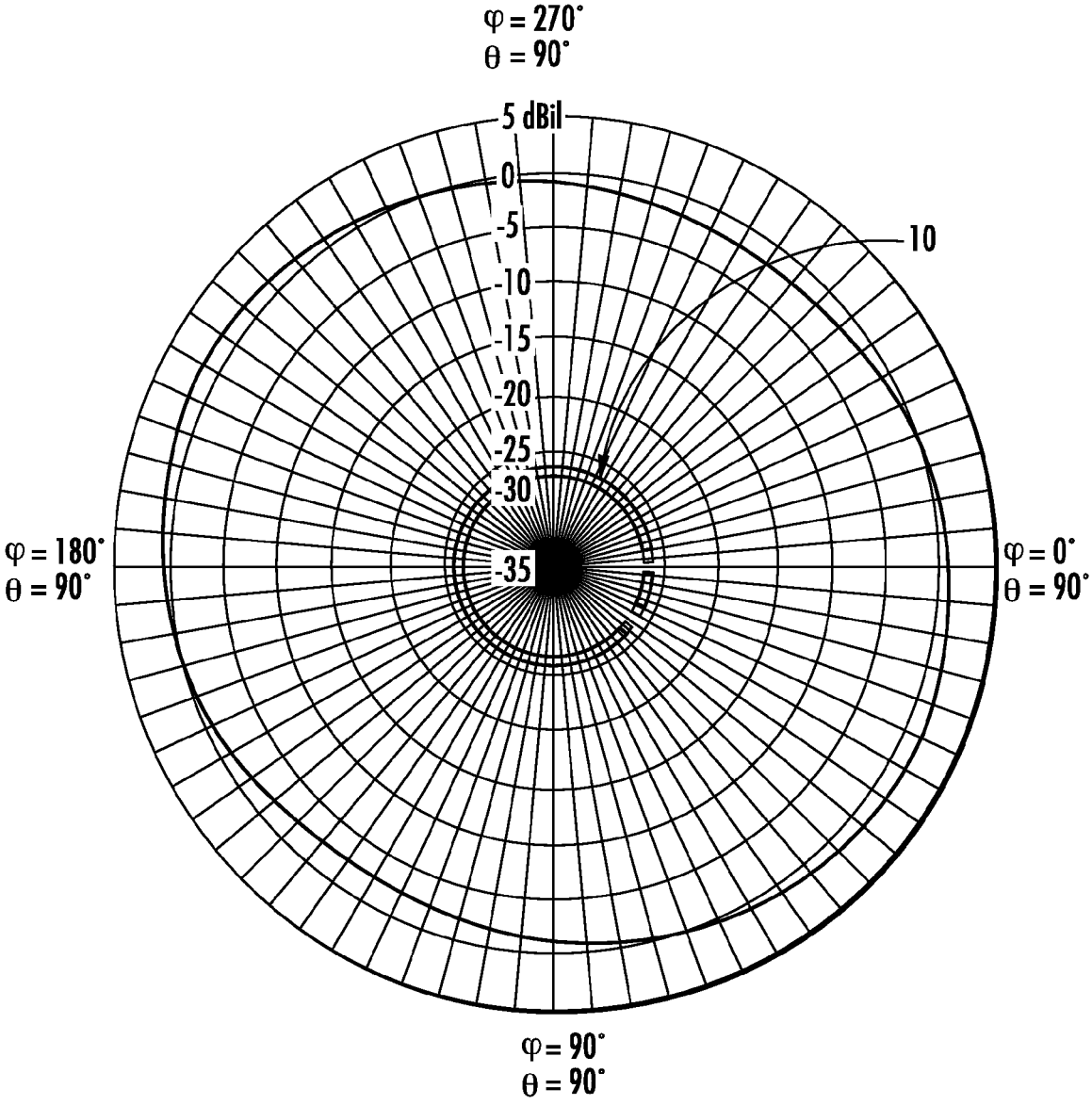
FIG. 2B is an XY plane cut radiation pattern graph for the loop antenna as shown in FIG. 1.
Figure 2C:
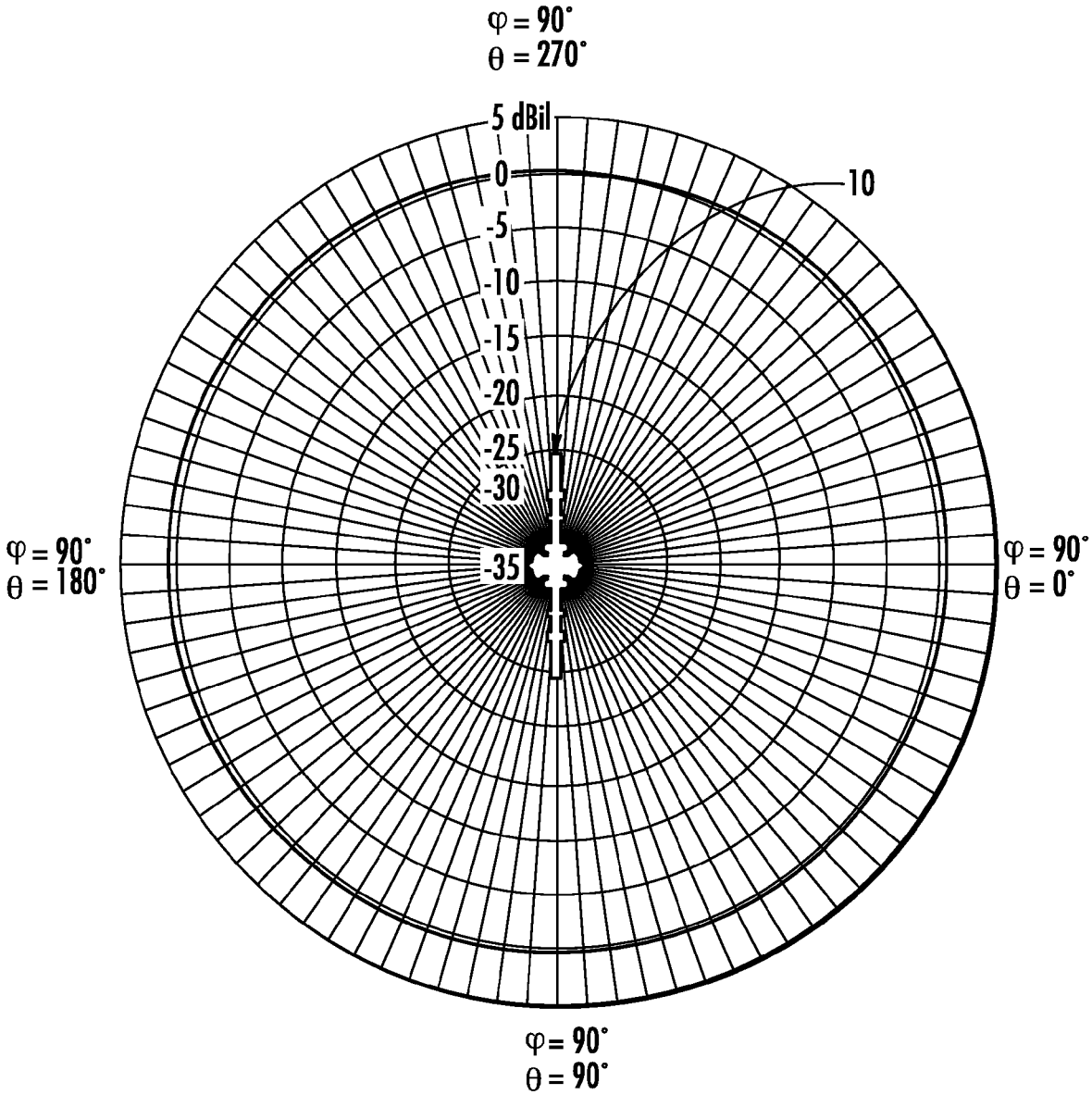
FIG. 2C is a YZ plane cut radiation pattern graph for the loop antenna as shown in FIG. 1.
Figure 2D:
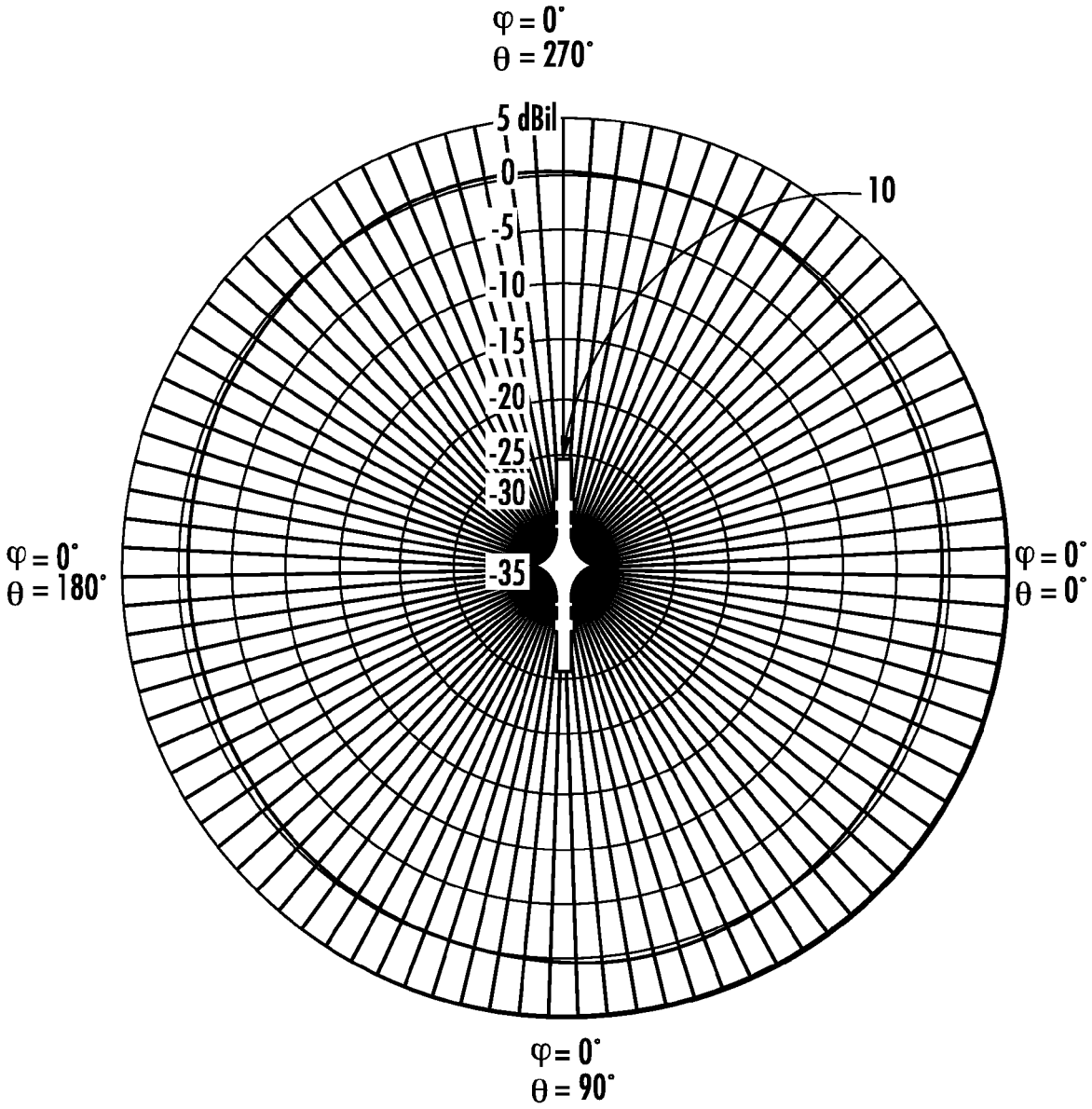
FIG. 2D is a ZX plane cut radiation pattern graph for the loop antenna as shown in FIG. 1.

Referring initially to FIG. 1, a loop antenna 10 includes first and second electrical conductors 11, 12 arranged to define a circular shape with first and second spaced apart gaps 13, 14 therein. The circular shape is configured so that the circumference is equal to a range of 0.3 to 0.6, and more preferably 0.5 times a wavelength of an operating frequency of the loop antenna 10. In other words, the circumference of the loop antenna 10 will vary according to a desired operating frequency.

The first and second electrical conductors 11, 12 are preferably copper traces with tin lead plating. The first and second conductors 11, 12 may be, for example, metal wires, metal tubing, a printed-wiring board trace, metal strips, conductive ink on paper, or other conductors, as will be appreciated by those skilled in the art. Moreover, the first and second conductors 11, 12 may be about 0.1 inches wide, for example. Other widths may be contemplated by those skilled in the art, so long as the width is less than the total outer circumference diameter of the loop antenna 10 divided by five.

Opposing portions of the first and second electrical conductors 11, 12 at the first gap 13 define a signal feedpoint 15. The signal feedpoint 15 may include a pair of terminals or a port, for example. The signal feedpoint 15 may be a 50-Ohm signal feedpoint, for example, however, the signal feedpoint can be configured for other resistances or even complex impedances. The signal feedpoint 15 may also receive a coaxial cable (not shown) that can be soldered across the first gap 13. Additionally, the first gap 13 has an angular width, as noted by angle $\alpha$ in FIG. 1 in a range of 0.001 to 10 degrees, and, for example, about 5 degrees between opposing portions of the first and second electrical conductors 11, 12. As will be appreciated, by those skilled in the art, alternative angular gap widths may be implemented.

Opposing portions of the first and second electrical conductors 11, 12 at the second gap 14 define an impedance tuning feature. The second gap 14 illustratively has an angular width, noted by angle $\beta$, in a range of 5 to 15 degrees, and, for example, about 10 degrees between opposing portions of the first and second electrical conductors 11, 12. As will be appreciated by those skilled in the art, alternative angular gap widths may be implemented. The center of the second gap 14 is circumferentially spaced from the center of the first gap 13 by an angle $\gamma$ less than ninety degrees, and the second gap 14 is greater than the first gap 13 to provide a predetermined impedance and an isotropic radiating pattern at the predetermined operating frequency for the loop antenna. For example, the operating frequency may be UHF, in other words, in a range of 300 MHz to 3 GHz. In this case, as the preferred circumference C is $0.5\lambda_{air}$, and the preferred diameter d is $0.5\lambda_{air}/\pi=0.16\lambda_{air}$, the outside diameter d of antenna 10 at UHF may range from 6.3 to 0.63 inches.

In a preferred embodiment, the center of the second gap 14 is circumferentially spaced from the center of the first gap by an angle γ in a range of 40-70 degrees from the first gap 13, and, more preferably, the angle may be 50 degrees to provide a 50-Ohm impedance at the feedpoint 15. As will be appreciated by those skilled in the art, the spacing between the second gap 14 and the first gap 13 may be varied to alter the impedance at the feedpoint 15. For example, moving the second gap 14 closer to the feedpoint 15, or in other words, decreasing the angle γ, raises the impedance seen at the feedpoint. Conversely, moving the second gap 14 further away from the feedpoint 15, or increasing the angle γ, will reduce the impedance seen at the feedpoint.

Coarse adjustment of frequency of operation for the loop antenna 10 may be accomplished by linear scaling, e.g. reducing or enlarging the size of the entire structure as whole, as reducing the wavelength reduces the size of the antenna. Antenna size is of course the reciprocal of frequency (Size ∝ 1/Frequency) so loop antenna 10 is made smaller for a higher frequency. Fine frequency adjustment, e.g. frequency trimming after antenna fabrication, may be accomplished by adjusting the width of the second gap 14, by ablation or otherwise. The width of the second gap 14 is denoted by angle β. As will be appreciated by those skilled in the art, antenna driving point impedance (z) is complex and expressed as z=r+jx, where r is the resistance and x is the reactance and j is the complex operator $\sqrt{-1}$. Loop antenna 10 is preferentially operated at resonance such that no reactance (jx=0) exists at first gap 13. Thus, adjustment of frequency, e.g. "tuning", is the reduction of driving point reactance to zero.

Antenna driving point resistance is independently adjustable from reactance, and may be accomplished by moving the position of the second gap 14 with respect to the first gap 13; the geometry of this is denoted by angle γ. Moving second gap 14 closer to the first gap 13 raises the resistance obtained and moving the second gap 14 away from the first gap 13 lowers the resistance obtained.

Figure 4:
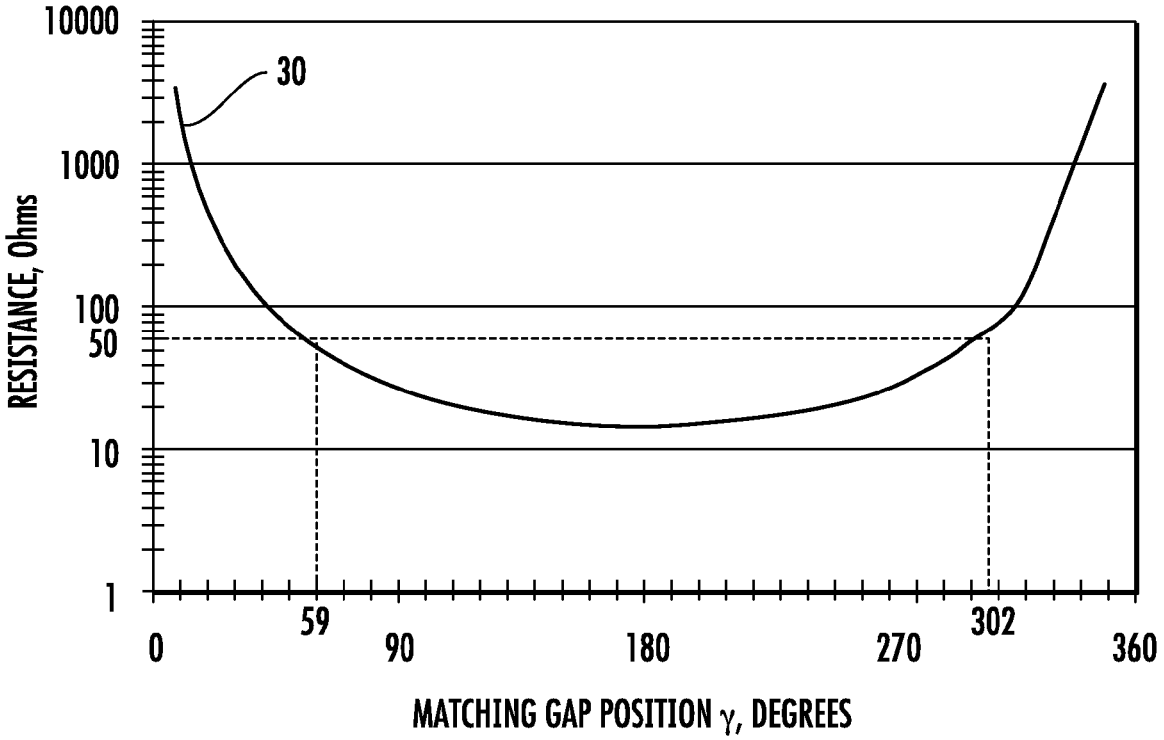
FIG. 4 is a graph of the driving point resistance for the loop antenna as shown in FIG. 1, as a function of gap position.

Referring now briefly to FIG. 4, the plot 30 shows the resistance obtained for the loop antenna 10 when it is at resonance, as a function of the angular position of the center of the second gap 14. Mathematically, the resistance obtained varies approximately as:

$$R=12+|30\cot(\gamma/2)|$$

Where:

R=Resistance at resonance at first gap 13 in Ohms

γ=Angle between center of the first gap 13 and the center of the second gap 14, in degrees or radians.

As will be appreciated by those skilled in the art, without the inclusion of the second gap 14, e.g., if the second gap 14 were shorted, the resistance at the first gap 13 or driving point could approach infinity in theory and thousands of Ohms might occur in practice. Note that the value of the reactance at the first gap 13, which is preferentially zero for resonance, is not appreciably affected by the angular position of the second gap 14. Thus, separate independent controls of reactance and resistance at the first gap 13, by adjustment of the second gap 14 width and the second gap 14 location respectively are provided.

Exact resonance in thin wire embodiments (i.e. a width smaller than diameter d divided by 20) has been observed with an antenna circumference C of 0.505 to 0.510 wavelengths, corresponding to an antenna outer diameter d of 0.161 to 0.162 wavelengths in air. Fat wire or wide trace embodiments of the loop antenna 10 (i.e. a width greater than the diameter d divided by 20) resonate at a smaller circumference C, for example, 0.45 wavelengths or less in some instances.

An optional variable capacitor 19 may be configured across the second gap 14 to provide a post-manufacture frequency adjustment, e.g. tuning. A simple formula to calculate the exact capacitance for a tuning shift may not be possible due to the stray capacitance of the second gap 14 geometry, but in general, the frequency shift is according to the circuit resonance formula $F=\frac{1}{2}n\sqrt{(LC)}$. For example, the frequency shift is the square root of the capacitance change ($\Delta F=\sqrt{(\Delta C)}$). Electrically variable capacitors, such as varactor diodes are also suitable for electronic tuning, as are other tuners, as will be appreciated by those skilled in the art.

Radiation efficiency of the loop antenna 10 will now be considered. When copper is used for the first and second electrical conductors 11, 12, resistive losses may be negligible and radiation efficiency may be increased. This is because the loop antenna 10 may have a radiation resistance ($R_r$) in the range of 8 to 14 Ohms, which is sufficient to overcome most conductor loss. A specific example for radiation efficiency is operation at 1000 MHz, for example, for PWB implementation, narrow copper traces 0.025 antenna diameters wide, and traces 0.0007 inches thick. The loop antenna 10 diameter d is then $0.5\lambda_{air}/\pi=0.16\lambda_{air}=1.9$ inches, the copper traces 0.05(1.9)=0.095 inches wide, and the radio frequency loss resistance ($R_1$) of the copper traces may be calculated to be 0.25 Ohms total. Radiation efficiency (η) is then approximately $[R_r/(R_r+R_1)]\times100\%=[10/(10+0.25)]\times100\%=98\%$. As will be appreciated by those skilled in the art, radiation resistance ($R_r$) is an artifice for analysis which indicates the transducer resistance at a current maxima in the antenna, and for electrically small loops with a uniform amplitude current distribution it is calculated by the well known formula $R_r=31{,}200\ \{[(\pi a^2)/\lambda^2]^2\}$, which is about 10 Ohms for a uniform current loop antenna the size of the loop antenna 10.

The loop antenna 10, however, has slightly more radiation resistance as the current amplitude distribution is sinusoidal or nearly so. $R_r$ has been measured at 12 to 14 Ohms in some prototypes. Note that the driving resistance provided at the first gap 13 is generally not the same as the radiation resistance, and the driving resistance may be adjusted to 50 Ohms or as otherwise desired by the location of the second gap 14.

The loop antenna 10 further illustratively includes a dielectric substrate 17 mounting the first and second electrical conductors 11, 12 thereon. The dielectric substrate may be made of IsoClad® 933, a non-woven fiberglass reinforced polytetrafluoroethylene (PTFE) composite material having a dielectric constant of about 2.33 and being available from Arlon Microwave Materials of Cucamonga, Calif. Other materials may also be used, as antenna tuning is little effected by the substrate dielectric constant, unlike microstrip patch antennas, for example. The first and second electrical conductors 11, 12 are illustratively positioned on a top-side of the dielectric substrate 17. A bottom-side of the dielectric substrate 17 is preferably left bare; that is, no electrical conductors are mounted thereon.

The loop antenna 10 advantageously radiates in all directions forming a substantially spherical radiation pattern. As illustrated in FIGS. 2*a*-2*d*, for example, the principal plane radiation patterns are isotropic to about within ±1.5 dB. The patterns illustrated in FIGS. 2*a*-2*d* are for total fields and were obtained by a method of moments calculation in the NEC4.1

Numerical Electromagnetic Code by Lawrence Livermore National Laboratory. Gain is defined in IEEE Standard 145-1993 and in units of dBi (decibels with respect to an isotropic antenna). As will be appreciated by those skilled in the art, 0.0 dBd (decibels with respect to a half wave dipole) equals 2.1 dBi. The isotropic pattern of the loop antenna 10 may reduce communication fades associated with orientation, for example, with tumbling satellites or misoriented pagers. If a circularly polarized antenna is used to link to the loop antenna 10, the loop antenna may be randomly oriented, and the aiming fades may be about 6 dB or below. This is because the polarization loss factor between linear and circular polarization is 3 dB and the deepest radiation pattern null in the loop antenna 10 is about 3 dB down from pattern peak. The loop antenna 10 is linearly polarized or mostly so in all directions.

Figure 3:
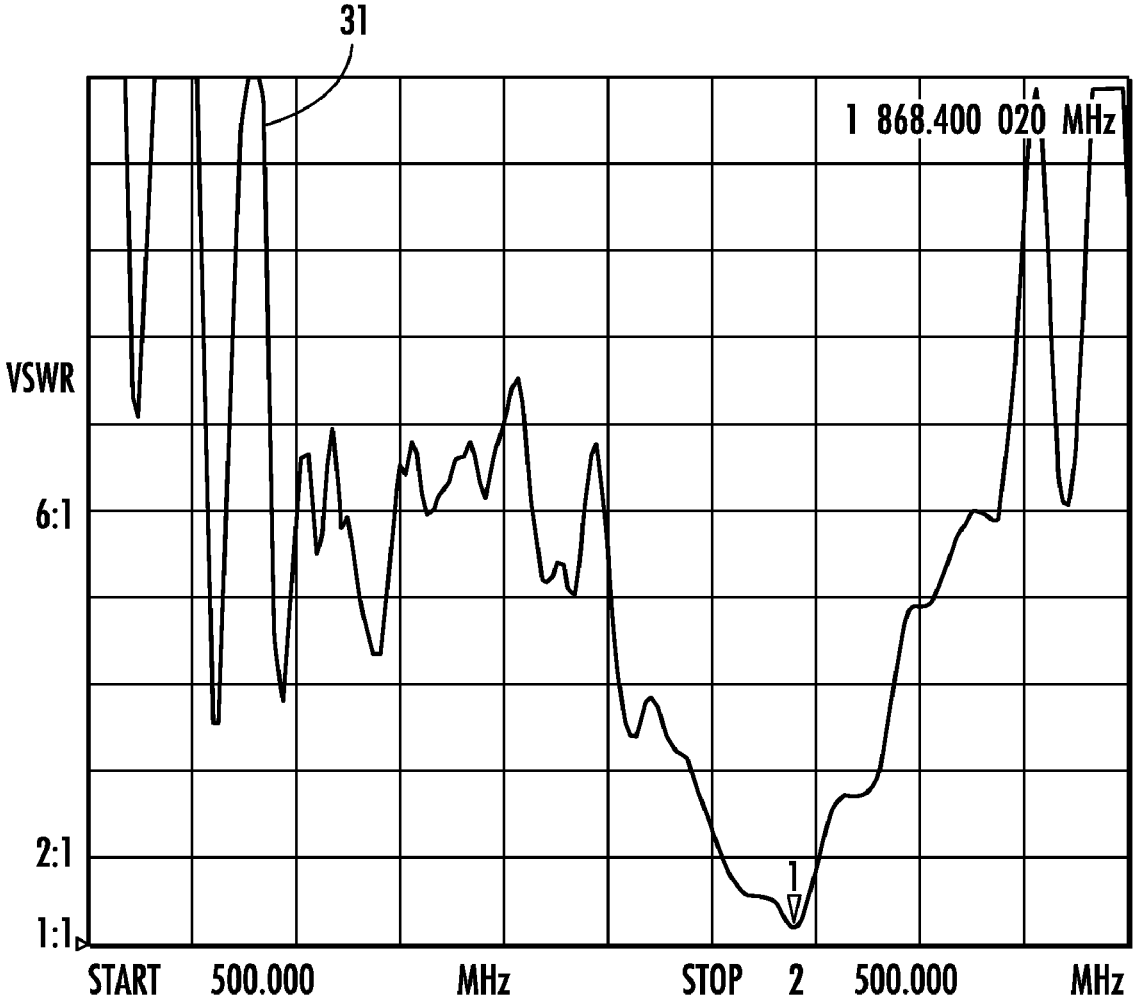
FIG. 3 is a voltage standing wave ratio response graph of the loop antenna as shown in FIG. 1.

Referring now to FIG. 3, the loop antenna 10 advantageously provides a reduced voltage standing wave ratio (VSWR) 31, and about 1.2:1 In other words, the maximum standing wave amplitude is 1.2 times greater than the minimum standing wave value of 1:1 in a 50 Ohm system. The VSWR of 1.2:1 is indicative of lower losses and a reduced reflected power radiated by the loop antenna 10, as will be appreciated by those skilled in the art. The outer circumference of the loop antenna 10 is measured at about 0.45 to 0.50 times the wavelength at the frequency of minimum VSWR, which is the first or fundamental resonance in the loop antenna 10. The exact circumference depends on the width of first and second electrical conductors 11, 12.

A performance summary for the loop antenna 10 is shown below in Table 1.

TABLE 1

Table 1: Example And Prototype

| Parameter | Value | Method |
|---|---|---|
| Implementation | Printed Wiring Board | — |
| PWB Material | Teflon, $\epsilon_r$ = 2.33 Farads/Meter | — |
| Conductors | Copper, Greater Than 5 Skin Depths (σ) Thick | Measured |
| Frequency | 1868.4 MHz | Specified |
| Outer Diameter | 0.90 Inches (0.14 $\lambda_{air}$) | Measured |
| Outer Circumference | 2.83 Inches (0.46 $\lambda_{air}$) | Measured |
| Trace Width | 0.045 Inches (0.007 $\lambda_{air}$) | Measured |
| First Gap 13 | $2.5 < \delta < -2.5$ Degrees (Gap Width $\alpha$ = 5 Degrees) | Measured |
| Second Gap 14 | $55 < \delta < 65$ Degrees (Gap Width $\beta$ = 10 Degrees, Gap Spacing $\gamma$ = 60 degrees) | Measured |
| Variable Capacitance 19 | 0.0 pf (No Capacitor Used) | — |
| System Impedance | 50 Ohms Nominal | Specified |
| Complex Driving Point Impedance | 52-4.6 j Ohms | Measured |
| VSWR At Resonance | 1.2 to 1 (VSWR Is A Dimensiionless Ratio) | Measured |
| Gain (At Peak) | +0.9 dBil (Decibels With Respect To Isotropic, Linear Polarization) | NEC4.1 |
| Instantaneous 3 dB Gain Bandwidth | 3.2% | Calculated |
| Polarization | Linear | Specified |
| Polarization Orientation | Horizontal When Antenna Is Operated In Horizontal Plane. | Measured |

TABLE 1-continued

Table 1: Example And Prototype

| Parameter | Value | Method |
|---|---|---|
| Radiation Pattern Shape | Nearly Isotropic (Spherical) | NEC4.1 |
| Radiation Pattern, Deviation From Isotropic | Less than +−1.5 dB | NEC4.1 |
| Radiation Efficiency | 98% | Calculated |
| Current Distribution Along Loop Conductors | Sinusoidal Amplitude, Constant Phase | NEC4.1 |
| Virtual Ground Node 18 | No connection thereto (Located At $\delta$ = 260 Degrees) | — |

The instantaneous bandwidth, e.g. fixed tuned bandwidth, of the loop antenna 10 varies with the trace width of the first and second electrical conductors 11, 12. For narrow traces, as described above, the 3 dB gain bandwidth is near 3.2 percent. For wide, fat loop conductors, as described above, the 3 dB gain bandwidth rises to about 10 percent. The tunable bandwidth can exceed the instantaneous bandwidth of the loop antenna 10 as the radiation pattern shape is stable over a bandwidth of about 20 to 30 percent. Multiple tuning extends instantaneous gain bandwidth, and it may be applied to the loop antenna 10 by external elements, such as a lumped element LC network interposed at the signal feedpoint 15. The double tuning form of multiple tuning generally provides about a $2^2$ bandwidth enhancement (400 percent).

As will be appreciated by those skilled in the art, small antennas may operate according to Chu's Limit for instantaneous gain bandwidth (Physical Limitations of Omni-Directional Antennas", L. J. Chu, Journal of Applied Physics, Volume 19, pp 1163-1175 December 1948). The 3 dB gain single tuning form of Chu's Limit is $BW_{3dB} \leqq 200(r/\lambda)^3$ for single tuning, and for a sphere, the diameter of the loop antenna 10 Chu's Limit can be calculated as $BW_{3dB} \leqq (100\%)200(0.16\lambda/\lambda)^3 \leqq 82\%$. As the loop antenna 10 may operate to about 10% 3 dB gain bandwidth, the loop antenna can operate near 10%/82%=8.2% of Chu's Limit for single tuning and 3 dB gain, which is sufficient for many purposes, and the loop antenna 10 may be advantaged for being planar rather than spherical. Antennas according to Chu's Limit may of course, be unknown.

Figure 5:
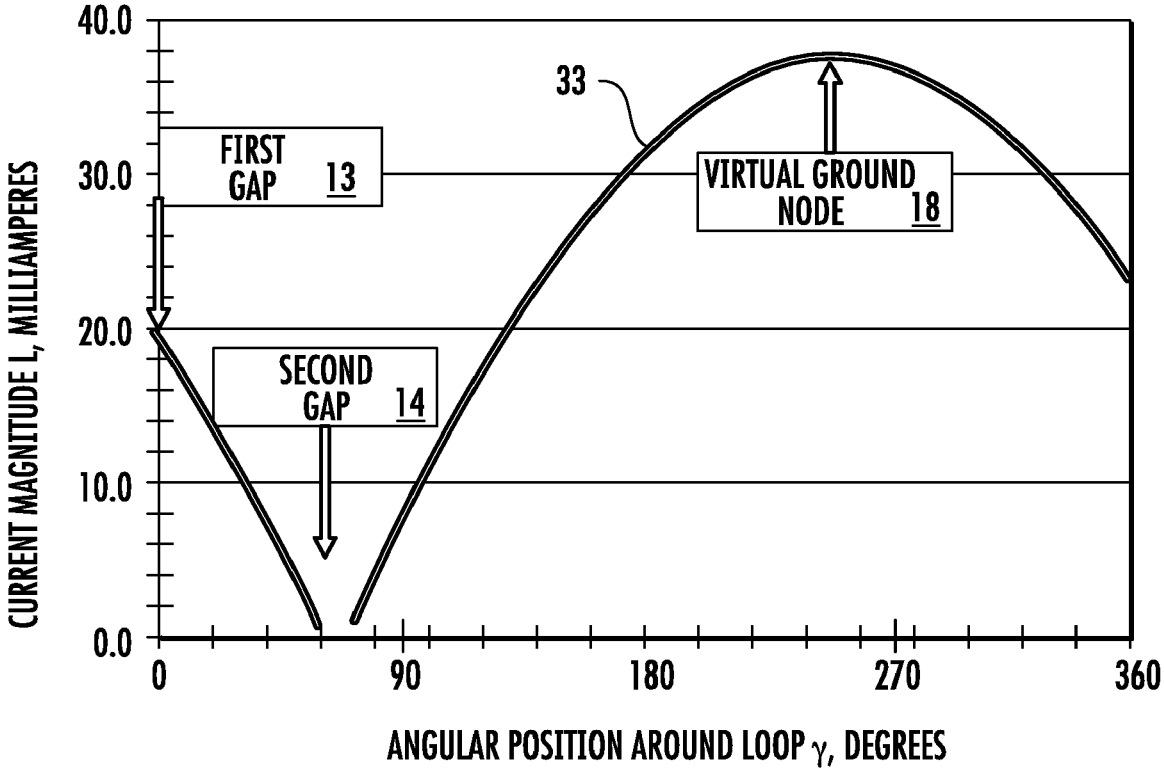
FIG. 5 is a graph of the current distribution along the loop conductors for the loop antenna as shown in FIG. 1.

It is also appropriate to consider the loop antenna 10 current distribution, as radiated far fields and antenna aperture distribution are reciprocal Fourier transforms. FIG. 5 illustrates the calculated current magnitude 33 for the loop antenna 10, along first and second electrical conductors 11, 12, for a 1-volt excitation at the first gap 13. As will be appreciated, the shape of the current magnitude distribution is sinusoidal and is a standing wave, e.g.:

$$I \propto |\sin[(\delta/2)+\gamma]|$$

Where:

I=the loop current in amps $\delta$, $\gamma$ as depicted in FIG. 1.

Although not plotted, the phase of the current distribution around the loop antenna 10 was nearly a constant value everywhere around the loop antenna, e.g. uniform in phase. In an NEC4.1 analysis of the Table 1 prototype, the phase of the current was between 2.8 and 4.6 degrees at all points along the loop. The current amplitude is always zero across the second gap 14, so repositioning the second gap 14 moves the standing wave maxima and minima around the loop conductor, and the first gap 13 may lie at a current maxima, current minima, or anywhere in between, as may benefit driving resistance needs.

Referring again to FIG. 1, a virtual ground node 18 for the loop antenna 10 is at the current maxima along the second electrical conductor 12, which occurred near δ=260 degrees for the loop antenna in the Table 1 example. The virtual ground node 18 is a point at which an electrical connection can be made to the loop antenna 10 with minimal electrical disturbance. For example, a metallic mast or metal handle (not shown) may be attached to the loop antenna 10 at the virtual ground node 18 without significant change to antenna radiation patterns or driving impedance. For outdoor use, an earth ground wire (not shown) may be connected at the virtual ground node 18 to drain static charge.

Figure 6:
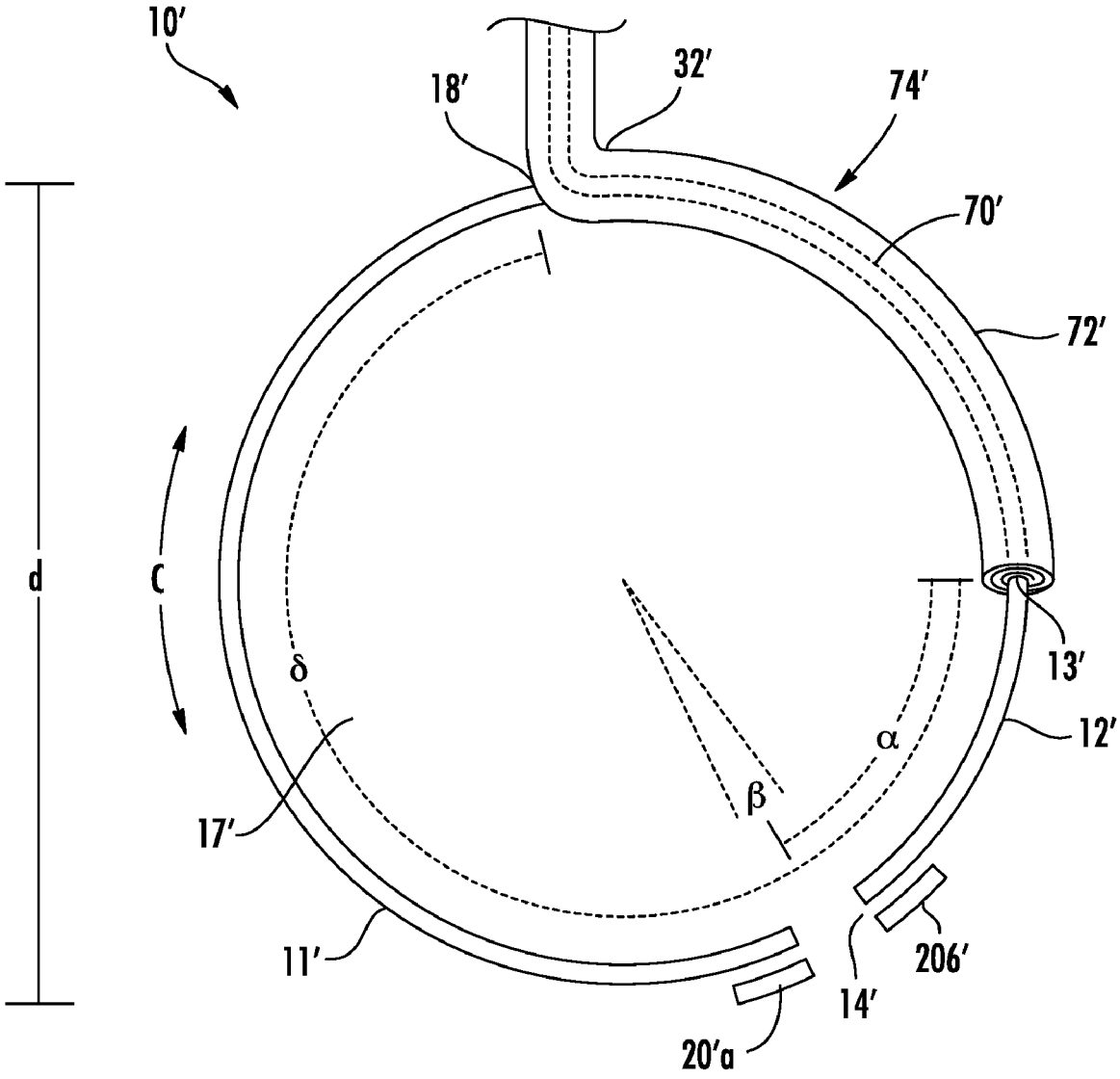
FIG. 6 is a top plan view of an another embodiment of the loop antenna in accordance the present invention.

Referring now to FIG. 6, an additional embodiment of the loop antenna 10' is described. The loop antenna 10' includes an inset coaxial feed, which may be mechanically coupled or for operation without a balun. The loop antenna 10' illustratively includes a coaxial transmission line 74' having an inner conductor 70' and outer conductor 72'. The coaxial transmission line 74' may include a dielectric fill (not shown) between the inner conductor 70' and the outer conductor 72'. The outer conductor 72' is removed at the first gap 13', and the inner conductor 70' illustratively extends beyond the first gap 13' to define the second electrical conductor 12'. The first gap 13' is measured by the radial distance separating the inner conductor 70' and the outer conductor 72', and is illustratively smaller than the second gap 14'.

Additionally, as can be appreciated by those in the art, a coaxial connector (not shown) may be configured at the first gap 13', and the second electrical conductor 12' may be formed by a separate conductive structure. The virtual ground node 18' conductively attaches the first electrical conductor 11' to the outer conductor 72' of coaxial transmission line 74' at bend 32'. Attachment may be by soldering or clamping, for example, or other form of attachment, as will be appreciated by those skilled in the art. The inner conductor 70' does not make any conductive connection to the first electrical conductor 11' at the bend 32'. The bend 32' in the coaxial transmission line 74' may be in any direction, although it may be preferred that the coaxial transmission line exit at a right angle to loop. Between the bend 32' and the first gap 13', the loop antenna 10' is formed from the outside of the outer conductor 72', e.g. an "inset feed".

Additionally, when the bend 32' occurs at the virtual ground node 18' of the loop antenna 10', common mode currents are diminished along the coaxial transmission line 74' beyond the first and second electrical conductors 11', 12', such that a balun function is provided by the inset feed geometry of the loop antenna. As will be appreciated by those skilled in the art, coaxial transmission lines 74' are capable of carrying radio frequency (RF) currents on their outer surface, in addition to the internal RF currents associated with power transmission. This effect is advantageously used to provide a portion of the loop antenna 10', and on the portion of the coaxial transmission line 74' external to the loop antenna. This effect is also avoided by joining the coaxial transmission line 74' at a current maxima or virtual ground point 18' of a low RF impedance and electrical symmetry in the loop antenna 10'. Thus, the coaxial transmission line 74' is coupled to radiate internally to the loop antenna 10' and to not radiate externally to the loop antenna.

Illustratively, two optional dielectric bodies 20*a*', 20*b*' are adjacent each side of the second gap 14' to provide fine frequency adjustment post manufacture, e.g. tuning. The dielectric bodies 20' may have different dielectric constants. Suitable materials for the dielectric bodies 20' can include styrene ($C_8H_8$), alumina ($Al_2O_3$), or barium titanate ($BaTiO_3$), or other dielectric material as will be appreciated by those skilled in the art. No dielectric bodies 20' may be used if no tuning effect is needed. Although cylindrical shapes may be preferred for the dielectric bodies 20', other shapes may be used. In other embodiments, the dielectric bodies 20' may be coupled to at each side of the second gap 14', and may be attached with adhesives, plastic clamps (not shown), or other forms of attachment.

Figure 7:
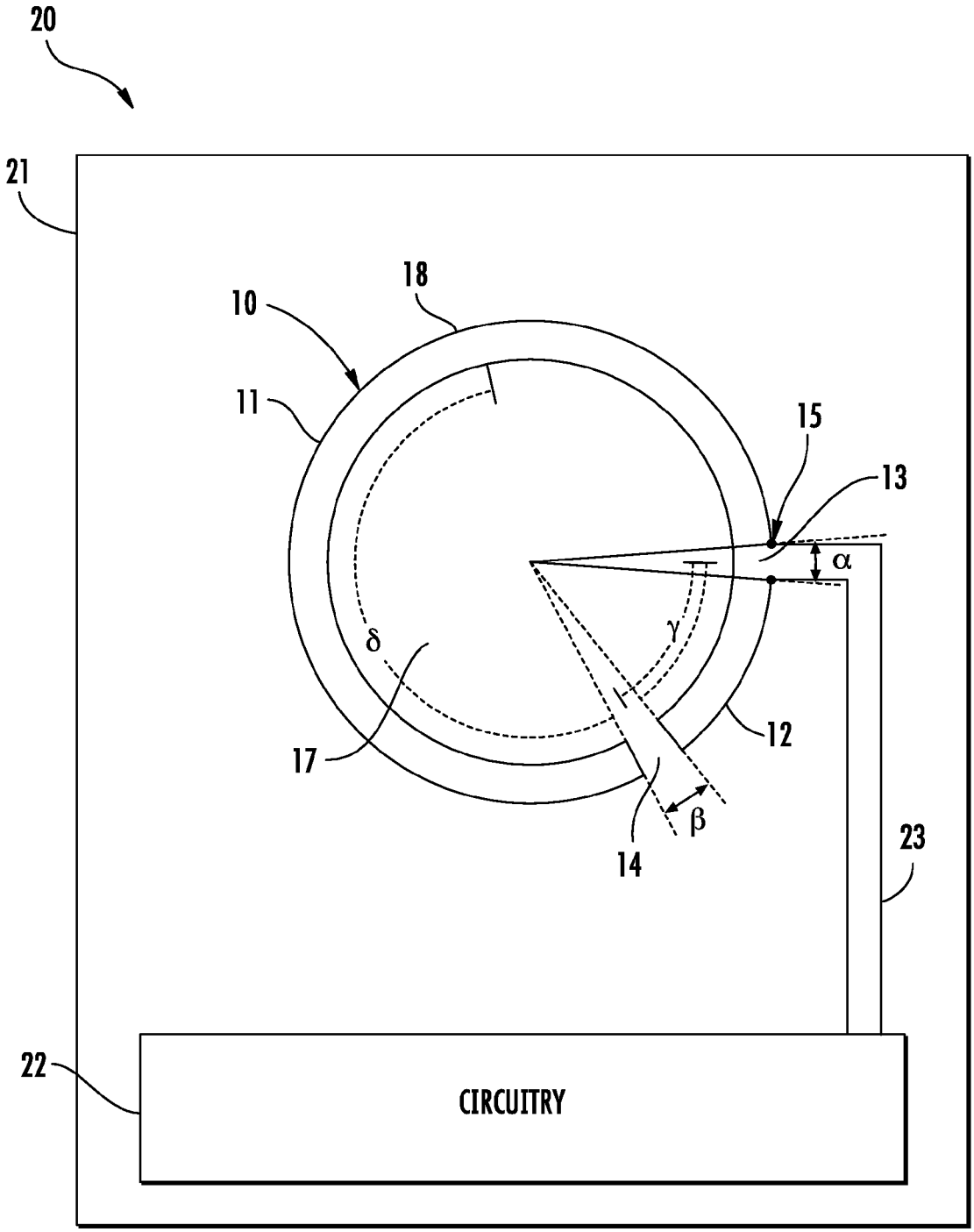
FIG. 7 is a schematic block diagram of a communications device including the loop antenna as shown in FIG. 1.

Referring now to FIG. 7, another aspect is directed to a communications device 20 illustratively including a housing 21. The loop antenna 10 is illustratively carried by the housing 21 and includes first and second electrical conductors 11, 12 arranged to define a circular shape with first and second spaced apart gaps 13, 14 therein. The loop antenna 10 further includes opposing portions of the first and second electrical conductors 11, 12 at the first gap 13 defining a signal feedpoint 15.

Opposing portions of the first and second electrical conductors 11, 12 at the second gap 14 define an impedance tuning feature. The second gap 14 is circumferentially spaced from the first gap 13 less than ninety degrees. The second gap has a greater angular width than the first gap to provide a predetermined impedance and an isotropic radiating pattern at a predetermined operating frequency for the loop antenna as discussed above.

The communications device 20 also includes circuitry 22 carried by the housing 21 and cooperating with the loop antenna 10" to process a signal therethrough. Additionally, the communications device 20 also includes a feed line 23 coupling the loop antenna 10 to the circuitry 22. Moreover, it should be understood that the loop antenna 10 may be embodied in various communications devices 20, such as RFID tags, RFCD radios, GPS receivers, cellular telephones, pages, WLAN cards, or other mobile wireless communications devices.

Referring again to FIG. 1, another aspect is directed to a method of making the loop antenna 10. The method includes arranging first and second electrical conductors 11, 12 to define a circular shape with first and second spaced apart gaps 13, 14 therein so that opposing portions of the first and second electrical conductors at the first gap 13 define a signal feedpoint 15. The first and second electrical conductors 11, 12 are also arranged so that their opposing portions at the second gap 14 define an impedance tuning feature. The method further includes arranging the first and second electrical conductors 11, 12 so that the second gap 14 is circumferentially spaced from the first gap 13 less than ninety degrees and forming the second gap to be greater than the first gap to provide a predetermined impedance and an isotropic radiating pattern at a predetermined operating frequency for the loop antenna 10.

As can be appreciated, isotropic antennas provide omnidirectional radiation patterns in all planes. Thus, the loop antenna 10 is also an omnidirectional antenna at any orientation. When mounted in the horizontal plane, the loop antenna 10 is well suited for FM broadcast reception with horizontal polarization, and is significantly smaller in size than the ½ wave dipole or dipole turnstile. At United States FM broadcast frequencies (88-108 MHz), the diameter of the loop antenna 10 is about 19 inches, while a half wave dipole is 60 inches long.

The loop antenna 10 is also useful for RF (high frequency) service as the radiation pattern includes NVIS (near vertical incidence) coverage, and it may be a wire structure supported on poles. The poles need only form loop conductors 11, 12 in a polygonal shape, which approximates the circular embodiment illustrated in FIG. 1. Of course the loop antenna 10 may operate on other frequencies.

Thus, the loop antenna 10 provides a substantially isotropic radiation pattern with high radiation efficiency and sufficient gain for many purposes. It operates at a reduced size relative wavelength, is planar for inexpensive manufacture, and it may avoid the need for antenna aiming. Accordingly, the loop antenna 10 is particularly advantageous for portable, unoriented devices, such as personal communications or radio location devices, such as tracking tags. Of course, the loop antenna 10 may be used in other devices, as will be appreciated by those skilled in the art.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A loop antenna comprising:

first and second electrical conductors arranged to define a circular shape with first and second spaced apart gaps therein, the circular shape having a circumference in a range of 0.3 to 0.6 times a wavelength of a predetermined operating frequency of the loop antenna;

opposing portions of the first and second electrical conductors at the first gap defining a signal feedpoint; and opposing portions of the first and second electrical conductors at the second gap defining an impedance tuning feature;

the second gap being circumferentially spaced from the first gap less than ninety degrees and the second gap being greater than the first gap to provide a predetermined impedance and a radiating pattern within +/−1.5 dB of isotropic at the predetermined operating frequency for the loop antenna.

2. The loop antenna according to claim 1, wherein the second gap is circumferentially spaced from the first gap by an angle in a range of 40 to 70 degrees.

3. The loop antenna according to claim 1, wherein the second gap has an angular width in a range of 5 to 15 degrees.

4. The loop antenna according to claim 1, wherein the first gap has an angular width in a range of 0.001 to 10 degrees.

5. The loop antenna according to claim 1, further comprising a dielectric substrate mounting the first and second electrical conductors thereon.

6. The loop antenna according to claim 1, wherein the signal feedpoint defines a 50-Ohm signal feedpoint.

7. The loop antenna according to claim 1, wherein a portion of said first electrical conductor comprises an outer conductor of a coaxial transmission line.

8. The loop antenna according to claim 7, wherein said second electrical conductor comprises an inner conductor of said coaxial transmission line extending outwardly beyond an end of said outer conductor.

9. The loop antenna according to claim 1, wherein at least one dielectric body is positioned at the second gap to define a frequency tuning feature.

10. A loop antenna comprising:

first and second electrical conductors arranged to define a circular shape with first and second spaced apart gaps therein, the circular shape having a circumference in a range of 0.3 to 0.6 times a wavelength of a predetermined operating frequency of the loop antenna;

opposing portions of the first and second electrical conductors at the first gap defining a signal feedpoint; and opposing portions of the first and second electrical conductors at the second gap defining an impedance tuning feature;

the second gap being circumferentially spaced from the first gap by an angle in a range of 40 to 70 degrees, and the second gap having an angular width in a range of 5 to 15 degrees to provide a predetermined impedance and a radiating pattern within +/−1.5 dB of isotropic at the predetermined operating frequency for the loop antenna.

11. The loop antenna according to claim 10, wherein the first gap has an angular width in a range of 0.001 to 10 degrees.

12. The loop antenna according to claim 10, further comprising a dielectric substrate mounting the first and second electrical conductors thereon.

13. The loop antenna according to claim 10, wherein the signal feedpoint defines a 50 Ohm signal feedpoint.

14. A communications device comprising:

a housing;

a loop antenna carried by said housing and comprising first and second electrical conductors arranged to define a circular shape with first and second spaced apart gaps therein, the circular shape having a circumference in a range of 0.3 to 0.6 times a wavelength of a predetermined operating frequency of the loop antenna, opposing portions of the first and second electrical conductors at the first gap defining a signal feedpoint, and opposing portions of the first and second electrical conductors at the second gap defining an impedance tuning feature, the second gap being circumferentially spaced from the first gap less than ninety degrees and the second gap being greater than the first gap to provide a predetermined impedance and a radiating pattern within +/−1.5 dB of isotropic at the predetermined operating frequency for the loop antenna;

circuitry carried by said housing; and a feed line coupling said loop antenna to said circuitry.

15. The communications device according to claim 14, wherein the second gap is circumferentially spaced from the first gap by an angle in a range of from 40 to 70 degrees.

16. The communications device according to claim 14, wherein the second gap has an angular width in a range of 5 to 15 degrees.

17. The communications device according to claim 14, wherein the first gap has an angular width in a range of 0.001 to 10 degrees.

18. A method of making a loop antenna comprising:

arranging first and second electrical conductors to define a circular shape with first and second spaced apart gaps therein so that the circular shape has a circumference in a range of 0.3 to 0.6 times a wavelength of a predetermined operating frequency of the loop antenna, opposing portions of the first and second electrical conductors at the first gap define a signal feedpoint, opposing portions of the first and second electrical conductors at the second gap define an impedance tuning feature, and the second gap is circumferentially spaced from the first gap less than ninety degrees with the second gap being greater than the first gap to provide a predetermined impedance and a radiating pattern within +/−1.5 dB of isotropic at the predetermined operating frequency for the loop antenna.

19. The method according to claim 18, wherein the second gap is circumferentially spaced from the first gap by an angle in a range of 40 to 70 degrees.

20. The method according to claim 18, wherein the second gap has an angular width in a range of 5 to 15 degrees.

21. The method according to claim 18, wherein the first gap has an angular width in a range of 0.001 to 10 degrees.

* * * * *